US009874889B1

(12) United States Patent
Zhao et al.

(10) Patent No.: US 9,874,889 B1
(45) Date of Patent: Jan. 23, 2018

(54) VOLTAGE REGULATOR

(71) Applicant: Marvell International Ltd., Hamilton (BM)

(72) Inventors: Xiaoxiao Zhao, Shanghai (CN); Yifeng Huang, San Jose, CA (US); Wenrong Qian, Shanghai (CN); Yongxu Wang, Shanghai (CN)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 15/201,046

(22) Filed: Jul. 1, 2016

Related U.S. Application Data

(60) Provisional application No. 62/189,319, filed on Jul. 7, 2015.

(51) Int. Cl.
*G05F 3/02* (2006.01)
*G05F 1/575* (2006.01)

(52) U.S. Cl.
CPC ..... *G05F 1/575* (2013.01)

(58) Field of Classification Search
USPC ..... 327/541
See application file for complete search history.

(56) References Cited

U.S. PATENT DOCUMENTS 7,253,596 B2 * 8/2007 Yamamoto ..... H02M 3/1588 323/281
7,633,280 B2 * 12/2009 Ivanov ..... G05F 1/575 323/316
2007/0285154 A1 * 12/2007 Darabi ..... H03B 21/01 327/551
2011/0121802 A1 * 5/2011 Zhu ..... G05F 1/575 323/281

* cited by examiner

*Primary Examiner* — Lincoln Donovan
*Assistant Examiner* — Patrick Chen

(57) ABSTRACT

Aspects of the disclosure provide a regulator circuit including an output circuit, an error detection circuit and an intermediate circuit. The output circuit is configured to receive a first supply voltage, output and regulate a second supply voltage based on a control signal. The error detection circuit is responsive to the first supply voltage, and is configured to compare the second supply voltage with a reference voltage, and generate an error signal with a voltage level that is indicative of a difference between the second supply voltage and the reference voltage. The intermediate circuit is configured to generate a first electrical current based on the error signal and a second electrical current based on the second supply voltage, combine the first electrical current and the second electrical current to generate a third electrical current, and generate the control signal at least partially based on the third electrical current.

14 Claims, 4 Drawing Sheets

VOLTAGE REGULATOR

INCORPORATION BY REFERENCE

This present disclosure claims the benefit of U.S. Provisional Application No. 62/189,319, "LOW DROPOUT VOLTAGE REGULATOR CAPABLE OF INSTANTANEOUS LOAD REGULATION AND REGULATING METHOD" filed on Jul. 7, 2015, which is incorporated herein by reference in its entirety.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Voltage regulators are used to provide a relatively stable supply voltage to electronic circuits. In an example, an integrated circuit (IC) chip includes a low dropout (LDO) voltage regulator to receive an external supply voltage and to generate an internal supply voltage that is relatively stable. The internal supply voltage is provided to supply power, for example, to various digital circuits on the IC chip.

SUMMARY

Aspects of the disclosure provide a regulator circuit that includes an output circuit, an error detection circuit and an intermediate circuit. The output circuit is configured to receive a first supply voltage and output a second supply voltage and is configured to regulate the second supply voltage based on a control signal. The error detection circuit is responsive to the first supply voltage. The error detection circuit is configured to compare the second supply voltage with a reference voltage, and generate an error signal with a voltage level that is indicative of a difference between the second supply voltage and the reference voltage. The intermediate circuit is configured to generate a first electrical current based on the error signal, and to generate a second electrical current based on the second supply voltage. The intermediate circuit is further configured to combine the first electrical current and the second electrical current to generate a third electrical current, and to generate the control signal at least partially based on the third electrical current.

According to an aspect of the disclosure, the intermediate circuit includes a first transistor configured to receive the first supply voltage at a channel terminal of the first transistor, and receive the error signal at a gate terminal of the first transistor. Thus, the first electrical current flows in the first transistor. Further, the intermediate circuit includes a second transistor configured to receive the second supply voltage at a channel terminal of the second transistor, and receive a bias voltage at a gate terminal of the second transistor to bias the second transistor for an operation. The second electrical current flows through the second transistor. In an example, the regulator circuit includes a bias circuit configured to generate the bias voltage to bias the second transistor.

In an example, the regulator circuit includes a variable resistor configured to change a resistance in response to a load current output from the output circuit. A frequency of a zero of the regulator circuit is a function of the resistance.

Further, in an example, the regulator circuit includes a current detection circuit configured to detect the load current, and control the variable resistor based on the detected load current.

In an example, the error detection circuit includes a differential pair coupled between the first supply voltage and a ground supply to compare the second supply voltage with the reference voltage, and generate the error signal.

Aspects of the disclosure provide a method for regulating voltage. The method includes receiving a first supply voltage by an output circuit, outputting and regulating a second supply voltage based on a control signal, providing the first supply voltage to power up an error detection circuit to generate an error signal with a voltage level that is indicative of a difference between the second supply voltage and a reference voltage, generating a first electrical current based on the error signal, generating a second electrical current based on the second supply voltage, combining the first electrical current and the second electrical current to generate a third electrical current and generating the control signal at least partially based on the third electrical current.

Aspects of the disclosure provide an integrated circuit (IC) chip that includes a voltage regulator to provide a power supply to one or more functional circuits on the IC chip. The voltage regulator includes an output circuit, an error detection circuit and an intermediate circuit. The output circuit is configured to receive a first supply voltage and output a second supply voltage and is configured to regulate the second supply voltage based on a control signal The error detection circuit is responsive to the first supply voltage. The error detection circuit is configured to compare the second supply voltage with a reference voltage, and generate an error signal with a voltage level that is indicative of a difference between the second supply voltage and the reference voltage. The intermediate circuit is configured to generate a first electrical current based on the error signal, and generate a second electrical current based on the second supply voltage, combine the first electrical current and the second electrical current to generate a third electrical current, and generate the control signal at least partially based on the third electrical current.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
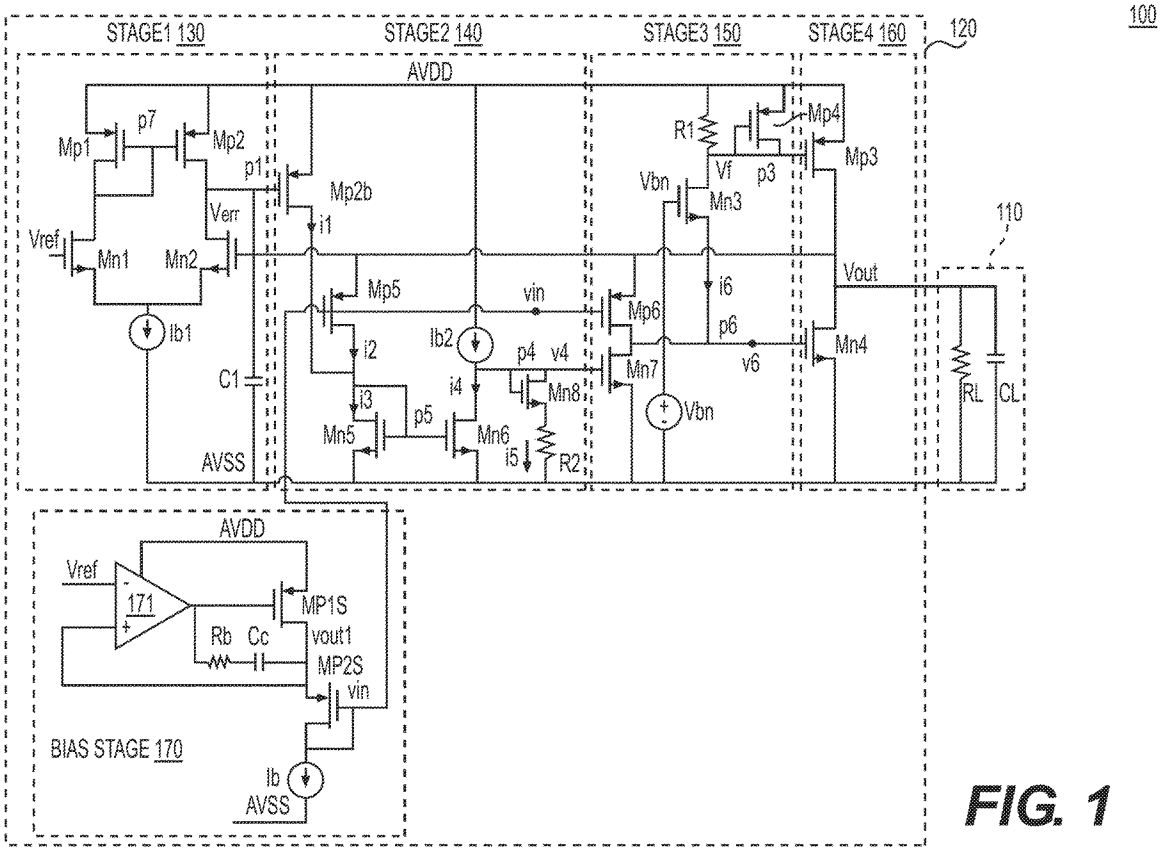
FIG. 1 shows a diagram of a circuit 100 according to an embodiment of the disclosure.

FIG. 1 shows a diagram of a circuit 100 according to an embodiment of the disclosure. The circuit 100 includes a voltage regulator 120 that is configured to receive a first supply voltage AVDD, generate and provide a second supply voltage Vout to a load circuit 110. The second supply voltage Vout has a voltage level that is relatively stable in response to various variations, such as noise in the first supply voltage AVDD, load current demand change in the load circuit 110, and the like. According to an aspect of the disclosure, the voltage regulator 120 uses multiple feedback loops to achieve, for example, stable output voltage, fast regulation response and the like. At least two feedback loops include signal paths that are combined in current mode instead of voltage mode in the circuit 100.

It is noted that the circuit 100 can be any suitable circuit that uses a voltage regular to generate a stable voltage to drive load circuits. In an example, the circuit 100 is an integrated circuit (IC) chip, such as a system-on-chip (SOC) that integrates various components, such as analog circuits, digital circuits, mixed-signal circuits, and the like on a chip. In an embodiment, the circuit 100 is configured to provide different supply voltages to the different circuits to achieve various advantages. For example, the circuit 100 provides the first supply voltage AVDD, such as about 1.4 V, to analog circuits (not shown) to satisfy operation requirement of the analog circuits. Further, in an example, the load circuit 110 includes digital circuits and can be driven by a relatively small voltage, such as about 1V, in order to save power. In the example, the voltage regulator 120 is configured to generate the second supply voltage Vout of 1V, and provide the second supply voltage Vout to the load circuit 110 to drive the digital circuits.

It is noted that, in the FIG. 1 example, the first supply voltage AVDD is a positive power supply, and the circuit 100 also receives a negative power supply AVSS. In an example, the negative power supply AVSS is ground. It is also noted that, in the example, the circuits in the load circuit 110 are lumped and represented using a load resistance RL and a load capacitance CL.

According to an aspect of the disclosure, the voltage regulator 120 is a low dropout (LDO) regulator that is configured to regulate the second supply voltage Vout even when the first supply voltage AVDD is close to the second supply voltage Vout. In the FIG. 1 example, the voltage regulator 120 includes four gain stages 130-160 that form multiple feedback loops and a bias stage 170 to provide bias voltages for the gain stages to enable proper operations of the gain stages. The first stage (stage 1) 130 includes an error amplifier circuit configured to generate an error signal indicative of a difference between the second supply voltage Vout and a reference voltage Vref. The second stage (stage 2) 140 and the third stage (stage 3) 150 include circuits to form multiple signal paths and to generate a control signal Vf based on the second supply voltage Vout. The fourth stage (stage 4) 160 is an output stage configured to output the second supply voltage Vout based on the control signal Vf. The bias stage 170 includes circuits to generate bias voltages to support the operations of the other stages.

Specifically, in the FIG. 1 example, the fourth stage 160 includes a transistor Mp3 in a pass transistor topology. The pass transistor Mp3 is configured to receive the first supply voltage AVDD at an input channel terminal of the pass transistor Mp3, and output the second supply voltage Vout at an output channel terminal of the pass transistor Mp3 based on the control signal Vf on a gate terminal of the pass transistor Mp3. In the example, the pass transistor Mp3 is implemented using a P-type metal oxide semiconductor field-effect transistor (MOSFET). The source of the pass transistor Mp3 receives the first supply voltage AVDD, the drain of the pass transistor Mp3 outputs the second supply voltage Vout, and the gate of the pass transistor Mp3 is controlled based on the control signal Vf which is generated based on the second supply voltage Vout to stabilize the second supply voltage Vout. For example, when the second supply voltage Vout tends to increase (e.g., due to a change in the load circuit 110), the gate voltage of the pass transistor Mp3 is controlled to increase so as to reduce the current flowing through the channel of the pass transistor Mp3 in order to maintain the second supply voltage Vout to be stable. In an example, the pass transistor Mp3 is configured to have a relatively large width to length ratio to be able to drive a relatively large current to the load circuit 110.

In the FIG. 1 example, the fourth stage 160 also includes a transistor Mn4 that is coupled with the pass transistor Mp3 in series. The transistor Mn4 is configured as a pull-down transistor to discharge and pull down the voltage level of the second supply voltage Vout when it is necessary. In the FIG. 1 example, the transistor Mn4 is implemented using an N-type MOSFET. In an example, when the load circuit 110 enters a power saving mode and the load current demand undergoes a step decrease, the gate voltage of the transistor Mn4 increases quickly, thus the transistor Mn4 is turned on quickly to sink the charges and allow sufficient time for the gate voltage of the pass transistor Mp3 to increase so as to reduce the current supplied by the pass transistor Mp3.

According to an aspect of the disclosure, the second supply voltage Vout is processed by multiple signal paths in the gain stages 130-150 to generate the control signal Vf.

For example, the first stage 130 generates an error signal Verr that is indicative of a difference between the second supply voltage Vout and a reference voltage Vref. In the FIG. 1 example, the first stage 130 includes transistors Mn1, Mn2, Mp1 and Mp2 and a first constant current source 1*b*1 coupled together to form a differential pair with MOS loads to compare the second supply voltage Vout with the reference voltage Vref and generate the error signal Verr at node p1. In an example, the reference voltage Vref is generated based on band-gap voltage by a reference circuit that is not shown. For example, the reference circuit is configured to generate the band-gap voltage and suitably scale the band-gap voltage to a desired voltage level, such as 1V and the like. The reference voltage Vref is relatively consistent and independent of various variations, such as temperature variation, supply voltage variation, process variation, and the like. The error signal Verr at node p1 has a voltage level that is indicative of the difference between the second supply voltage Vout and the reference voltage Vref.

In the FIG. 1 example, the error signal Verr changes in an opposite direction as the second supply voltage Vout, thus when the second supply voltage Vout increases, the error signal Verr decreases, and when the second supply voltage Vout decreases, the error signal Verr increases. The first stage 130 also includes an internal capacitor C1 coupled between the node p1 and the ground AVSS to provide frequency compensate for the feedback loop in order to stabilize the feedback loop.

In the FIG. 1 example, the transistors Mn1 and Mn2 are N-type MOSFETs, and the transistors Mp1 and Mp2 are P-type MOSFETs. The first stage 130 is coupled between the first supply voltage AVDD and the ground AVSS and powered up by the first supply voltage AVDD. In an example, the first stage 130 is configured to have a relatively large gain. It is noted that, in another example, the first stage 130 uses other suitable differential pair topology.

The second stage 140 and the third stage 150 are also coupled between the first supply voltage AVDD and the ground AVSS. Specifically, the second stage 140 includes transistors Mp2*b*, Mp5, Mn5, Mn6, Mn8, resistor R2, a second constant current source 1*b*2, and the third stage 150 includes transistors Mp6, Mn7, Mn3 and Mp4, and resistor R1 coupled together as shown in FIG. 1. The transistors Mp2*b*, Mp5, Mp6 and Mp4 are P-type MOSFETs, and the transistors Mn5, Mn6, Mn8, Mn7 and Mn3 are N-type MOSFETs.

In the FIG. 1 example, the error signal Verr output from the first stage 130 is provided to the gate of the transistor Mp2*b*, the source of the transistor Mp2*b* is connected to the first supply voltage AVDD, thus a first current i1 flowing through the transistor Mp2*b* is a function of the error signal Verr, and thus is a function of the second supply voltage Vout. The first current i1 changes in the same direction as the second supply voltage Vout, thus when the second supply voltage Vout increases, the first current i1 increases, and when the second supply voltage Vout decreases, the first current i1 decreases.

Further, in the second stage 140, a second current (i2) flowing through the transistor Mp5 is also a function of the second supply voltage Vout. In the example, the gate of the transistor Mp5 receives a bias voltage vin provided by the bias stage 170, and the source of the transistor Mp5 is connected to the second supply voltage Vout, thus the second current i2 flowing thought the transistor Mp5 is a function of the second supply voltage Vout. The second current i2 also changes in the same direction as the second supply voltage Vout.

Further, in the second stage 140, the first current i1 and the second current i2 are combined into a third current i3 flowing through the transistor Mn5. Thus, the third current i3 is a function of the second supply voltage Vout and changes in the same direction as the second supply voltage Vout. The transistors Mn5 and Mn6 form a current mirror. In an example, the transistors Mn5 and Mn6 are of the same size, thus a fourth current i4 flowing through the transistor Mn6 is about the same as the third current i3. Thus, the fourth current i4 is a function of the second supply voltage Vout and changes in the same direction as the second supply voltage Vout.

In the FIG. 1 example, the second constant current source 1*b*2 provides the fourth current i4 flowing through the transistor Mn6 and a fifth current i5 flowing through the diode-connected transistor Mn8 and the resistor R2. The sum of the fourth current i4 and the fifth current i5 is constant, thus the fifth current i5 is also a function of the second supply voltage Vout and changes in the opposite direction from the second supply voltage Vout. Further, the voltage v4 at node p4 depends on the fifth current i5 flowing through resistor R2, and thus the voltage v4 is a function of the second supply voltage Vout, and changes in the opposite direction from the second supply voltage Vout.

Further, in the FIG. 1 example, the transistor Mp6 and the transistor Mn7 are connected in series, the source of the transistor Mp6 receives the second supply voltage Vout, the gate of the transistor Mp6 receives the bias voltage vin provided by the bias stage 170, the gate terminal of the transistor Mn7 receives the voltage v4, the source of the transistor Mn7 is connected to the ground AVSS, the drain of the transistor Mp6 and the drain of the transistor Mn7 are connected at node p6. The voltage v6 at the node p6 is collectively affected by the second supply voltage Vout at the source of the transistor Mp6 and the voltage v4 at the gate of the transistor Mn7. Thus, the voltage v6 is a function of the second supply voltage Vout, and changes in the same direction as the second supply voltage Vout.

Further, in the FIG. 1 example, the gate of the transistor Mn3 is biased by a constant voltage Vbn. In an example the constant voltage Vbn is provided by the bias stage 170. The source of the transistor Mn3 is connected to the node p6, and the drain of the transistor Mn3 is connected to the gate of the pass transistor Mp3 to provide the control signal Vf. The drain of the transistor Mn3 is also connected to the resistor R1 and the diode-connected transistor Mp4. Thus the control voltage Vf is affected by the voltage v6, and is a function of the second supply voltage. The control voltage Vf changes in the same direction as the second supply voltage Vout.

During operation, in an example, when the second supply voltage Vout tends to increase, the control voltage Vf also increases, thus the pass transistor Mp3 is less turned on (e.g., the channel of the pass transistor Mp3 is shallower), to suppress the second supply voltage Vout from increasing. When the second supply voltage Vout tends to decrease, the control voltage Vf also decreases, thus the pass transistor Mp3 is turned on harder (e.g., the channel of the pass transistor Mp3 is deeper), to suppress the second supply voltage Vout from decreasing.

The bias stage 170 is configured to generate bias voltages, such as the bias voltage vin, the constant voltage Vbn, and the like. It is noted that the bias stage 170 can use any suitable topology to generate the bias voltages. In the FIG. 1 example, the bias state 170 includes an operational amplifier 171, transistors MP1S and MP2S, a current source 1*b*, a resistor Rb and a capacitor Cc coupled together as shown in FIG. 1 to generate the bias voltage vin. The transistor MP1S is a P-type MOSFET in a pass transistor configuration to receive the first supply voltage AVDD at the source of the transistor MP1S and output a voltage vout1 at the drain of the transistor MP1S. The operational amplifier 171 compares the voltage vout1 with the reference voltage Vref, and controls the gate of the transistor MP1S based on the comparison, such that the voltage vout1 is about the same as the Vref, and is about the same as the second supply voltage Vout. In an example, the transistor Mp5 and Mp6 have matching sizes as the transistor MP2S, thus when the bias voltage vin is provided to the gate of the transistor Mp5 and the transistor Mp6, the DC bias current of the transistor Mp5 and the transistor Mp6 mirror the current following through the transistor MP2S, which is provided by the current source 1*b*. It is noted that, in an example, the transistor MP2S is suitably scaled to be different from the transistor Mp5.

According to an aspect of the disclosure, the voltage regulator 120 includes three paths to adjust the control signal Vf in response to a change in the second supply voltage Vout. The three paths and the transistor Mp3 form three feedback loops. According to an aspect of the disclosure, the three feedback loops are respectively configured to have different characteristics, such as one with large gain, one with fast response time, and the like, such that the voltage regulator 120 has desired characteristics, such as fast regulation response, stable operation and the like. Specifically, the first feedback loop is formed by the transistor Mp3 and a first path that includes the transistor Mp5, the transistor Mn5, the transistor Mn6, the transistor Mn7 and the transistor Mn3. The first feedback loop has a relatively small DC gain and a relatively large bandwidth.

The second feedback loop is formed by the transistor Mp3 and a second path that includes the transistor Mp6, and the transistor Mn3. In an example, the DC gain of the second feedback loop is much smaller than the DC gain of the first feedback loop.

The third feedback loop is formed by the transistor Mp3 and a third signal path that includes the transistor Mn2, the transistor Mp2*b*, the transistor Mn5, the transistor Mn6, the transistor Mn7 and the transistor Mn3. In an example, the third feedback loop has a relatively large DC gain and a relatively small bandwidth.

In the FIG. 1 example, first path and the third path are merged in the current mode. On the third path, the first current i1 is generated as a function of the second supply voltage Vout. On the first path, the second current i2 is generated as a function of the second supply voltage Vout. The first current i1 and the second current i2 are combined into the third current i3.

In a related example, multiple paths are merged in the voltage mode. For example, in the related example, the gate of the transistor Mp5 is connected to the node p1 to receive the error signal Verr instead of the bias voltage vin, such that the current flowing through the transistor Mp5 is affected by both the second supply voltage Vout at the source of the transistor Mp5 and the error signal Verr at the gate of the transistor Mp5. In the related example, the first stage is configured to be powered up by the second supply voltage Vout to achieve suitable DC bias current in the transistor Mp5. Using the second supply voltage to power the first stage limits a lower boundary for the second supply voltage Vout. For example, the second supply voltage Vout needs to be equal to or larger than a sum of a voltage over the current source 1*b*1, the source-drain voltage of the transistor Mn1 and the gate-source voltage of the transistor Mp1. In an example, the sum of the voltage over the current source 1*b*, the source-drain voltage of the transistor Mn1 and the gate-source voltage of the transistor Mp1 is about 0.7 V. When the second supply voltage Vout needs to be smaller than the lower boundary (e.g., 0.7 V), the related example does not work. In the FIG. 1 example, the first path and the third path are merged in the current mode, the bias stage 170 provides the bias voltage vin to enable suitable DC bias current in the transistor Mp5, and the first stage 130 uses the first supply voltage AVDD as the power supply, thus the lower boundary for the second supply voltage Vout is not limited by the first stage 130.

Further, according to an aspect of the disclosure, the voltage regulator 120 includes the diode-connected transistor Mp4 coupled between the first supply voltage AVDD and the gate of the pass transistor Mp3. Generally, the gate of the pass transistor Mp3 has a relatively large area, thus the parasitic capacitance on the gate is relatively large. The diode-connected transistor Mp4 dynamically traces the load current, and makes a pole at the gate of the transistor Mp3 to be much higher than a gain-bandwidth product (GBW). Further, according to the disclosure, the voltage regulator 120 is suitably designed to lower the resistance at the node p4, the node p5 and the node p6, such that the poles at those nodes are much higher than the GBW.

According to an aspect of the disclosure, when the load current is relatively large, the voltage regulator 120 is stable. Specifically, the first feedback loop has a first loop gain Af1 that is represented by Eq. 1 in an example:

$$Af1=-g_{Mp5}M(R2+1/g_{Mn8})g_{Mn7}(1/g_{Mp4}//R1)g_{Mp3}(r_{oMp3}//r_{oMn4}//RL//CL) \quad \text{Eq. 1}$$

In Eq. 1, $g_{Mp5}$ denotes the transconductance of the transistor Mp5, M denotes a current conducting capability (e.g., W/L) ratio between the transistor Mn6 and the transistor Mn5

$$\left(M=\frac{W_{Mn6}}{L_{Mn6}}\Big/\frac{W_{Mn5}}{L_{Mn5}}\right),$$

R2 denotes the resistance of the resistor R2, $g_{Mn8}$ denotes the transconductance of the transistor Mn8, $g_{Mn7}$ denotes the transconductance of the transistor Mn7, $g_{Mp4}$ denotes the transconductance of the transistor Mp4, R1 denotes resistances of the resistor R1, $g_{Mp3}$ denotes the transconductance of the transistor Mp3, $r_{oMp3}$, denotes the output resistance of the transistor Mp3, $r_{oMn4}$ denotes the output resistance of the transistor Mn4, RL denotes the load resistance, and CL denotes the load capacitance. It is noted that the load resistance is lumped resistance and the load capacitance is lumped capacitance by circuits in the load circuit 110.

The second feedback loop has a second loop gain Af2 that is represented by Eq. 2 and then Eq. 3 in an example:

$$Af2=-g_{Mp6}(1/g_{Mp4}//R1)g_{Mp3}(r_{oMp3}//r_{oMn4}//RL//CL) \quad \text{Eq. 2}$$

$$Af2=g_{Mp6}/(g_{Mp5}M(R2+1/g_{Mn8})g_{Mn7})Af1 \quad \text{Eq. 3}$$

In Eq. 2 and Eq. 3, $g_{Mp6}$ denotes the transconductance of the transistor Mp6.

The third feedback loop has a third loop gain As1 that is represented by Eq. 4 in an example:

$$As1=g_{Mn2}(r_{oMp2}//r_{oMn2}//C1)(g_{Mp2b}/g_{Mp5})Af1 \quad \text{Eq. 4.}$$

In Eq. 4, $g_{Mn2}$ denotes the transconductance of the transistor Mn2, $r_{oMp2}$ denotes the output resistance of the transistor Mp2, $r_{oMn2}$ denotes the output resistance of the transistor Mn2, $g_{Mp2b}$ denotes the transconductance of the transistor Mp2*b*.

Further, when $g_{Mp2b}=g_{Mp5}$, the third loop gain As1 is represented by Eq. 5 in an example:

$$As1=g_{Mn2}(r_{oMp2}//r_{oMn2}//C1)Af1 \quad \text{Eq. 5}$$

From Eq. 3, the second loop gain Af2 is much smaller than the first loop gain Af1. The total loop gain AL is a sum of the first loop gain Af1, the second loop gain Af2 and third loop gain As1 and is about a sum of the first loop gain Af1 and the third loop gain As1.

In an example, A1-A4 are defined according to Eqs. 6-9:

$$A1=g_{Mn2}(r_{oMp2}//r_{oMn2})=g_{mn2}r_{o2} \quad \text{Eq. 6}$$

$$A2=g_{Mp5}(R2+1/g_{Mn8}) \quad \text{Eq. 7}$$

$$A3=g_{Mp3}(r_{oMp3}//r_{oMn4}//RL)=g_{Mp3}r_o \quad \text{Eq. 8}$$

$$A4=g_{Mn7}(1/g_{Mp4}//R1) \quad \text{Eq. 9}$$

Then, the frequency response of the loop gain AL(s) is represented by Eq. 10 in an example:

$$AL(s)=\frac{A1A2A4A3+A2A4A3(1+r_{o2}C1s)}{(1+r_{o2}C1s)(1+r_oCLs)}=A2A4A3(A1+1)\frac{1+\frac{r_{o2}C1}{A1+1}s}{(1+r_{o2}C1s)(1+r_0CLs)} \quad \text{Eq. 10}$$

Thus, the system has two poles P1 and P2 and one zero Z1 that are represented by Eqs. 11-13 in an example:

$$P1=\frac{1}{2\pi r_{02}C1} \quad \text{Eq. 11}$$

$$P2=\frac{1}{2\pi r_0CL} \quad \text{Eq. 12}$$

$$Z1 = \frac{A1+1}{2\pi r_{02}C1} \approx \frac{g_{Mn2}}{2\pi C1} \quad \text{Eq. 13}$$

When the load current is large, P1 is assumed to be smaller than P2, P2 is assumed to be smaller than Z1, and the gain bandwidth product (GBW) is calculated as shown by Eq. 14 in an example, and the voltage regulator 120 is stable.

$$GBW = \frac{g_{Mn2}r_{o2}A2A3A4}{2\pi r_{o2}C1} = \frac{g_{Mn2}A2A3A4}{2\pi C1} > Z1 \quad \text{Eq. 14}$$

When the load current is small, the GBW is smaller than Z1. According to an aspect of the disclosure, a variable resistor is added in the voltage regulator 120 to improve the feedback loop stability.

Figure 2:
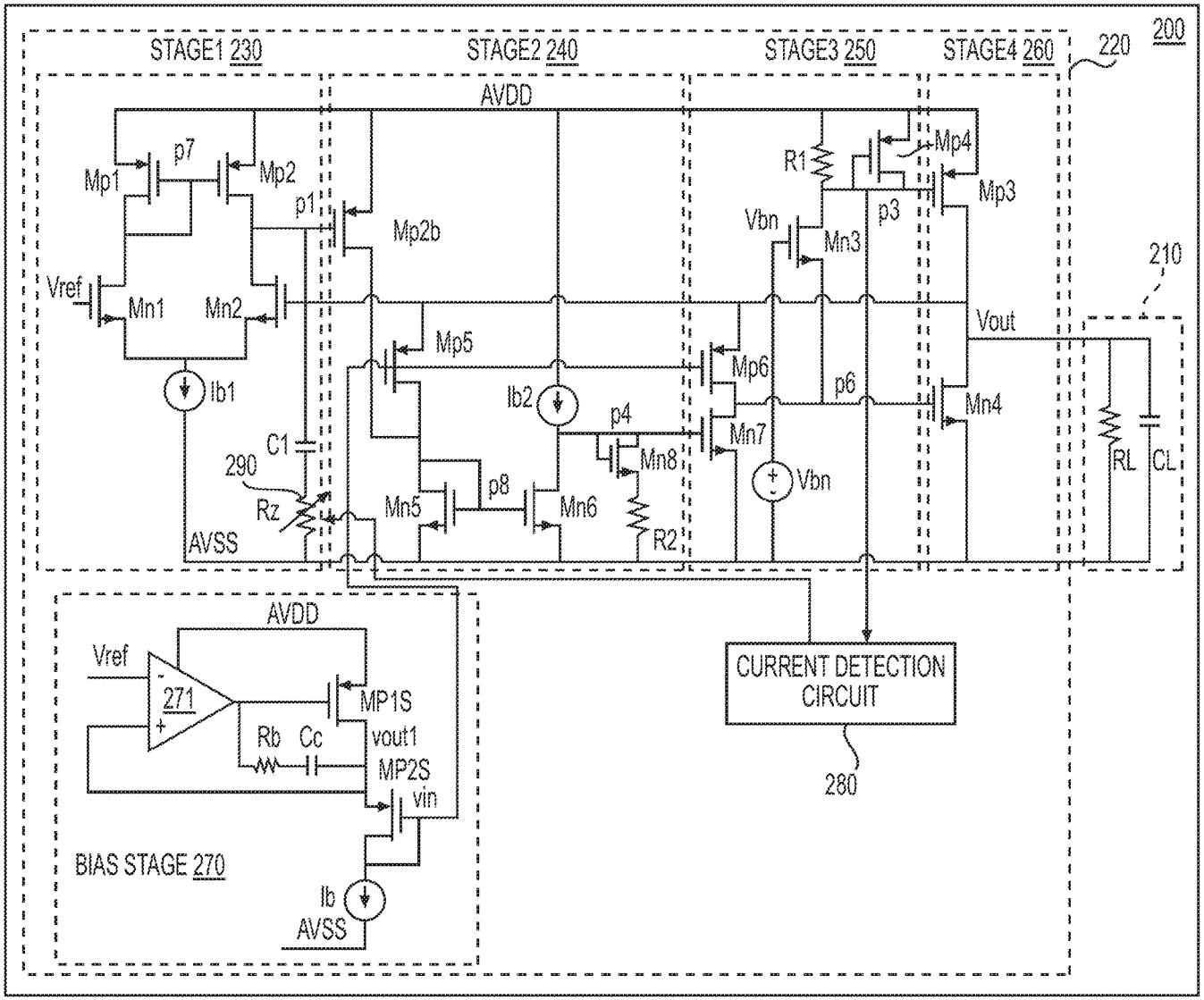
FIG. 2 shows a diagram of another circuit 200 according to an embodiment of the disclosure.

FIG. 2 shows a diagram of a circuit 200 according to an embodiment of the disclosure. The circuit 200 operates similarly to the circuit 100 described above. The circuit 200 also utilizes certain components that are identical or equivalent to those used in the circuit 100; the description of these components has been provided above and will be omitted here for clarity purposes.

In the FIG. 2 example, the circuit 200 includes a variable resistor 290 coupled between the internal capacitor C1 and the negative power supply AVSS, and a current detection circuit 280. The variable resistor 290 is configured to have a variable resistance Rz. The current detection circuit 280 is configured to detect the load current, and control the variable resistor 290 according to the detection to improve feedback loop stability.

In an example, the variable resistor 290 is designed to have much smaller resistance than the output resistance of the first stage 230, then the location of the first pole P1 and the location of the second pole P2 are almost same as the poles in the FIG. 1 example. The zero Z1 in FIG. 2 is represented as in Eq. 15 in an example:

$$Z1 = \frac{g_{Mn2}(r_{o2}+R_Z)A2A3A4}{2\pi(A2A3A4(r_{o2}+R_Z)C1 + g_{Mn2}(r_{o2}+R_Z)A2A3A4R_ZC1)} \quad \text{Eq. 15}$$

When the load current is larger, the location of the zero is almost the same as in the FIG. 1 example.

When load current is small, the zero Z1 is represented as in Eq. 16 in an example:

$$Z1 = \frac{g_{Mn2}(r_{o2}+R_Z)}{2\pi(1+g_{Mn2}R_Z)(r_{o2}+R_Z)C1} = \frac{g_{Mn2}}{(1+g_{Mn2}R_Z)2\pi C1} \quad \text{Eq. 16}$$

Thus, for small load current, the location of the zero Z1 is decreased by $(1+g_{Mn2}R_Z)$. The resistance Rz of the variable resistor 290 is properly designed in an example to keep the feedback loop to be stable across small load current to large load current.

Figure 3:
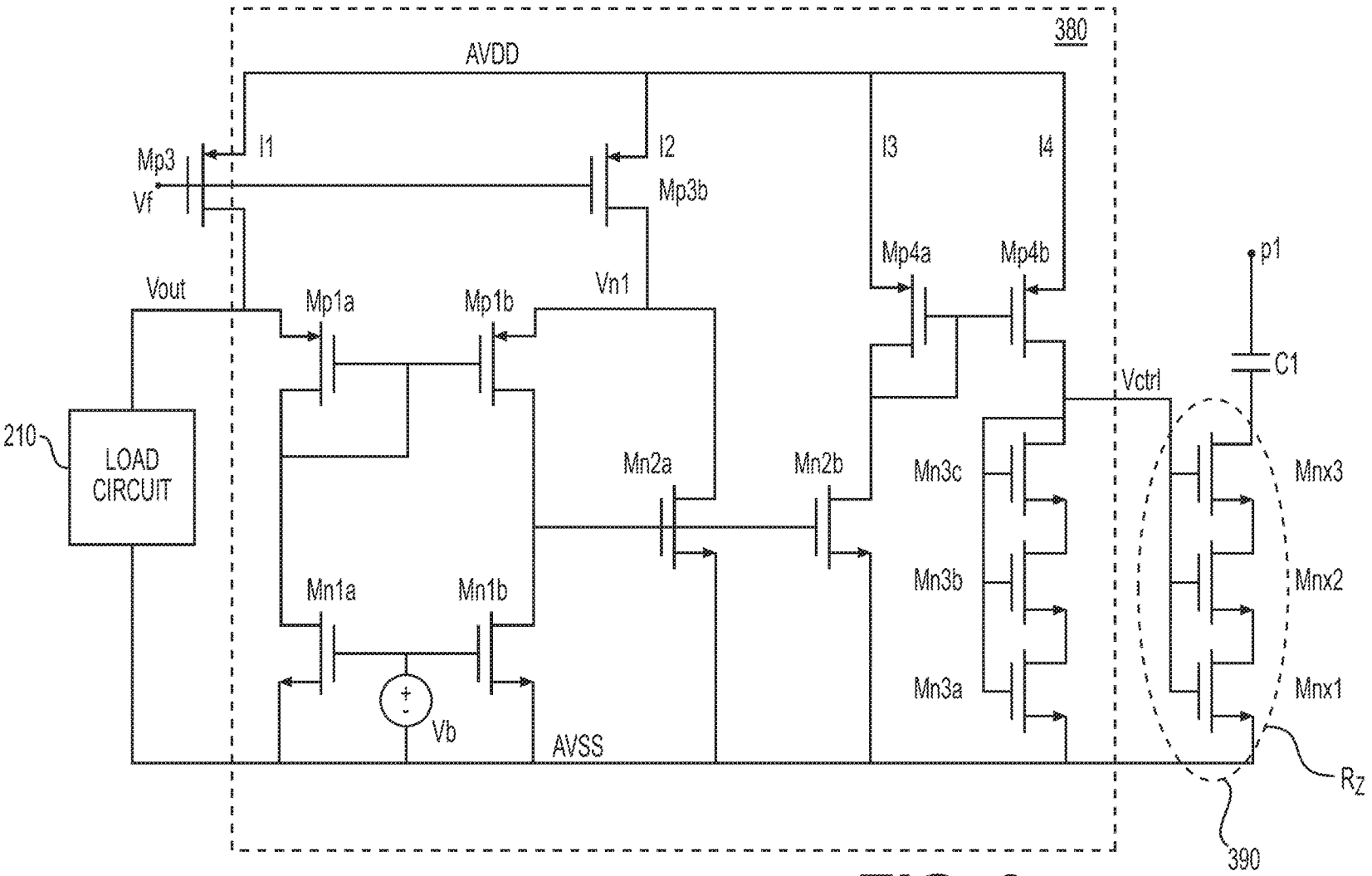
FIG. 3 shows a current detection circuit 380 coupled with a variable resistor 390 according to an embodiment of the disclosure.

FIG. 3 shows a current detection circuit 380 coupled with a variable resistor 390 according to an embodiment of the disclosure. In an example, the current detection circuit 380 is used in the circuit 200 in the place of the current detection circuit 280, and the variable resistor 390 is used in the circuit 200 in the place of the variable resistor 290. The current detection circuit 380 and the variable resistor 390 are coupled other components in the circuit 200, such as the pass transistor Mp3, the load circuit 210, and the internal capacitor C1, as shown in FIG. 3.

In the FIG. 3 example, the current detection circuit 380 includes transistors Mp1*a*, Mp1*b*, Mn1*a*, Mn1*b*, Mp3*b*, Mn2*a*, Mn2*b*, Mp6*a*, Mp6*b* and Mn3*a*-3*c*, and the variable resistor 390 includes transistors Mnx1-Mnx3 coupled together as shown in FIG. 3. The transistors Mn1*a*, Mn1*b*, Mn2*a*, Mn2*b*, Mn3*a*-3*c*, and Mnx1-Mnx3 are N-type MOSFETs, and the transistors Mp1*a*, Mp1*b*, Mp3*b*, Mp6*a* and Mp6*b* are P-type MOSFETs.

Further, in an example, the transistors Mn1*a* and Mn1*b* are matching transistors, the transistors Mp1*a* and Mp1*b* are matching transistors, the transistors Mn2*a* and Mn2*b* are matching transistors, and the transistors Mp6*a* and Mp6*b*. In an example, matching transistors are transistors having the same configurations, such as the same channel width, the same channel length, the same width/length ratio, of the same layout, near each other, layout in the same direction, and the like.

In the FIG. 3 example, the variable resistor 390 includes the transistors Mnx1-Mnx3 with gate connected together. The resistance of the variable resistor 390 is a function of a voltage Vctrl received at the gate of the transistors Mnx1-Mnx3.

The transistor Mp3*b* is arranged in parallel with the pass transistor Mp3. In an example, the transistor Mp3*b* is suitably scaled down from the pass transistor Mp3. Because of the transistors Mp1*a*, Mp1*b*, Mn1*a* and Mn1*b*, the drain voltage (Vn1) of the transistor Mp3*b* is about the same as the drain voltage (the second supply voltage Vout) of the pass transistor Mp3. The gate of the transistor Mp3*b* receives the control voltage Vf as the gate of the pass transistor Mp3, and the source of the transistor Mp3*b* is connected to the first supply voltage AVDD, thus the current I2 flowing in the transistor Mp3*b* is proportional to the current I1 (load current) flowing in the pass transistor Mp3 and is used to indicate the load current. In an example, because the transistors Mn2*a* and Mn2*b* are matching transistors, the current I3 flowing through the transistor Mn2*b* is a function of the current I2 and is a function of the load current. Further, because the transistors Mp2*a* and Mp2*b* are matching transistors, the current I4 flowing through the transistor Mp2*b* and the transistors Mn3*a*-Mn3*c* is a function of the load current. Then, the drain voltage Vctrl of the transistor Mp6*b* is a function of the load current, and is provided to the variable resistor 390 to adjust the resistance Rz of the variable resistor 390. Thus, the resistance Rz of the variable resistor 390 is a function of the load current.

Figure 4:
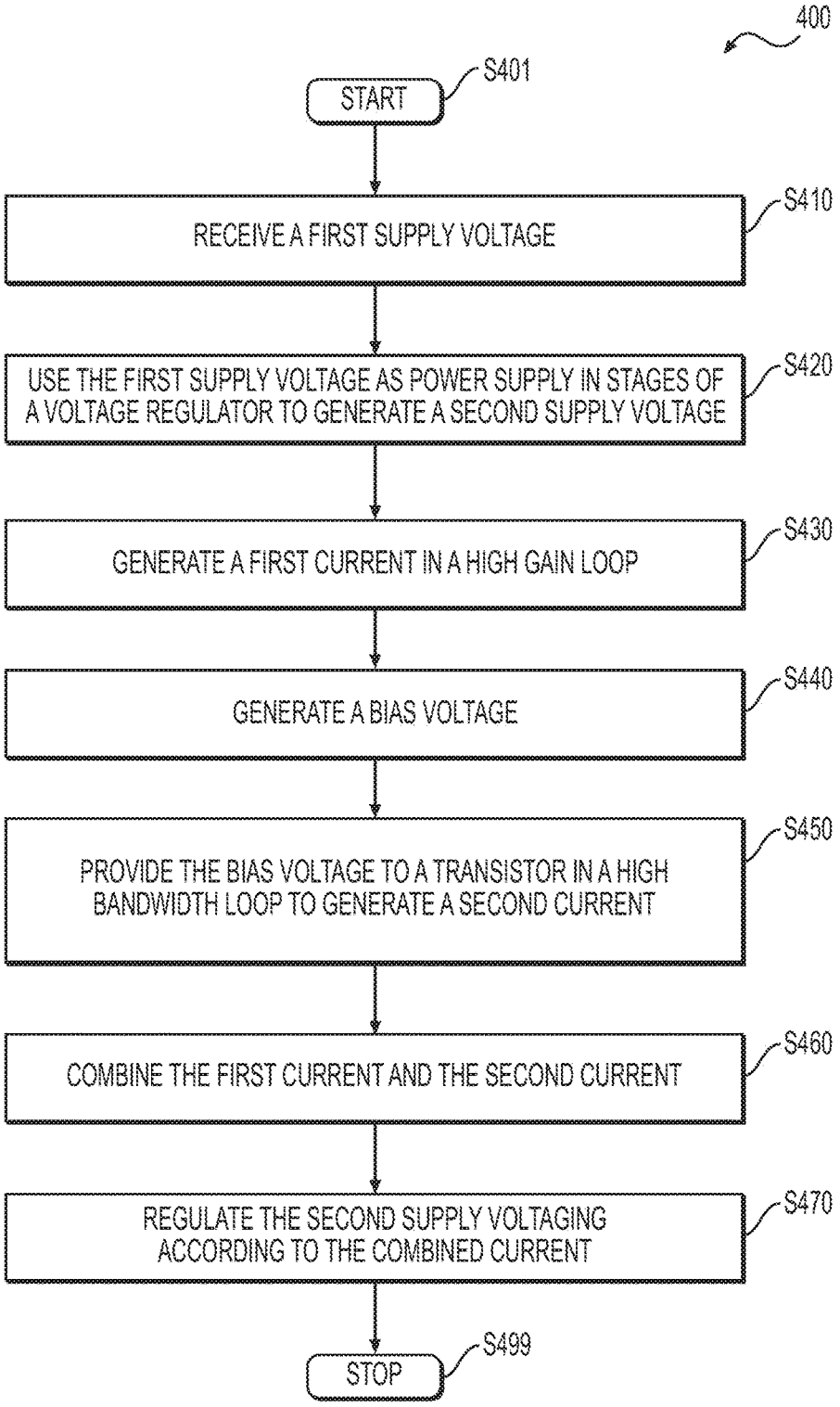
FIG. 4 shows a flow chart outlining a process 400 for regulating voltage according to an embodiment of the disclosure.

FIG. 4 shows a flow chart outlining a process 400 for regulating a voltage according to an embodiment of the disclosure. In an example, the process is executed in the voltage regulator 120 in the FIG. 1 example. The process starts at S401 and proceeds to S410.

At S410, a first supply voltage is received. In the FIG. 1 example, the voltage regulator 120 receives the first supply voltage AVDD.

At S420, the first supply voltage is used as power supply in stages of the voltage regulator to generate a second supply voltage. In the FIG. 1 example, the first supply voltage AVDD in used in the first stage 130, the second stage 140, the third stage 150 and the fourth stage 160 as the power supply to generate the second supply voltage Vout.

At S430, a first current is generated in a high gain loop. In the FIG. 1 example, the first stage 130 compares the second supply voltage Vout with the reference voltage Vref, and generates an error signal Verr with a voltage level indicative of a difference between the second supply voltage Vout and the reference voltage. Generally the first stage has a relatively large DC gain. The error signal Verr controls the gate of the transistor Mp2*b*, thus the current i1 flowing through the transistor Mp2*b* is a function of the second supply voltage Vout. In the FIG. 1 example, the signal path to generate the current i1 has a relatively high DC gain and a relatively low bandwidth.

At S440, a bias voltage is generated. In the FIG. 1 example, the bias stage 170 is configured to generate the bias voltage Vin to bias the transistors Mp5 and Mp6 to have suitable DC bias current.

At S450, the bias voltage is provided to a transistor in a high bandwidth loop to generate a second current. In the FIG. 1 example, the bias voltage vin is provided to bias the gate of the transistor Mp5, and the source of the transistor Mp5 receives the second supply voltage Vout, thus the current i2 flowing through the transistor Mp5 is a function of the second supply voltage Vout. In the FIG. 1 example, the signal path to generate the current i2 has a relatively low DC gain and a relatively large bandwidth.

At S460, the first current and the second current are combined. In the FIG. 1 example, both the first current i1 and the second current i2 flow through the transistor Mn5 to be combined.

At S470, the second supply voltage is regulated at least partially based on the combined current. In the FIG. 1 example, the gate voltage of the transistor Mn7 is a function of the combined current. A change in the gate voltage of the transistor Mn7 affects the control voltage Vf to the gate of the pass transistor Mn3, and thus regulates the second supply voltage Vout output from the drain of the pass transistor Mn3. Then the process proceeds to S499 and terminates.

When implemented in hardware, the hardware may comprise one or more of discrete components, an integrated circuit, an application-specific integrated circuit (ASIC), etc.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. A regulator circuit, comprising:

an output circuit configured to receive a first supply voltage, and configured to output a second supply voltage, and regulate the second supply voltage based on a control signal;

an error detection circuit responsive to the first supply voltage, the error detection circuit configured to compare the second supply voltage with a reference voltage, and to generate an error signal having a voltage level that is indicative of a difference between the second supply voltage and the reference voltage; and an intermediate circuit configured to generate a first electrical current based on the error signal and to generate a second electrical current based on the second supply voltage, the intermediate circuit further configured to combine the first electrical current and the second electrical current to generate a third electrical current, and to generate the control signal at least partially based on the third electrical current, wherein the intermediate circuit comprises:

a first transistor configured to receive the first supply voltage at a channel terminal of the first transistor, and to receive the error signal at a gate terminal of the first transistor, and the first electrical current flows through the first transistor; and a second transistor configured to receive the second supply voltage at a channel terminal of the second transistor, and to receive a bias voltage at a gate terminal of the second transistor to bias the second transistor for an operation, and the second electrical current flows through the second transistor.

2. The regulator circuit of claim 1, further comprising:

a bias circuit configured to generate the bias voltage to bias the second transistor for the operation.

3. The regulator circuit of claim 1, further comprising:

a variable resistor configured to change a resistance in response to a load current output from the output circuit, a frequency of a zero of the regulator circuit being a function of the resistance.

4. The regulator circuit of claim 3, further comprising:

a current detection circuit configured to detect the load current, and control the variable resistor based on the detected load current to adjust the frequency of the zero.

5. The regulator circuit of claim 1, wherein the error detection circuit further comprises:

a differential pair coupled between the first supply voltage and a ground supply to compare the second supply voltage with the reference voltage, and generate the error signal.

6. A method for regulating voltage, comprising:

receiving a first supply voltage by an output circuit;

outputting and regulating a second supply voltage by the output circuit based on a control signal;

providing the first supply voltage to power up an error detection circuit to generate an error signal with a voltage level that is indicative of a difference between the second supply voltage and a reference voltage;

generating a first electrical current based on the error signal by providing the first supply voltage to a channel terminal of a first transistor and providing the error signal to a gate terminal of the first transistor to generate the first electrical current that flows through the first transistor;

generating a second electrical current based on the second supply voltage by providing the second supply voltage to a channel terminal of a second transistor and providing a bias voltage at a gate terminal of the second transistor to generate the second electrical current that flows through the second transistor;

combining the first electrical current and the second electrical current to generate a third electrical current; and generating the control signal at least partially based on the third electrical current.

7. The method of claim 6, further comprising:

generating the bias voltage based on the first supply voltage to bias the second transistor for an operation.

8. The method of claim 6, further comprising:

adjusting a resistance of a variable resistor in response to a load current output from the output circuit to adjust a frequency of a zero.

9. The method of claim 8, further comprising:

detecting the load current output from the output circuit; and controlling the variable resistor based on the detected load current.

10. The method of claim 6, wherein providing the first supply voltage to power up the error detection circuit to generate the error signal with the voltage level that is indicative of the difference between the second supply voltage and the reference voltage further comprises:

providing the first supply voltage and a ground supply to a differential pair to compare the second supply voltage with the reference voltage, and generate the error signal.

11. An integrated circuit (IC) chip, comprising:

a voltage regulator comprising:

an output circuit configured to receive a first supply voltage and output a second supply voltage, and configured to regulate the second supply voltage based on a control signal;

an error detection circuit responsive to the first supply voltage, the error detection circuit configured to compare the second supply voltage with a reference voltage, and to generate an error signal with a voltage level that is indicative of a difference between the second supply voltage and the reference voltage; and an intermediate circuit configured to generate a first electrical current based on the error signal, and generate a second electrical current based on the second supply voltage, the intermediate circuit configured to combine the first electrical current and the second electrical current to generate a third electrical current, and to generate the control signal at least partially based on the third electrical current, wherein the intermediate circuit comprises:

a first transistor configured to receive the first supply voltage at a channel terminal of the first transistor, and to receive the error signal at a gate terminal of the first transistor, and the first electrical current flows through the first transistor; and a second transistor configured to receive the second supply voltage at a channel terminal of the second transistor, and receive a bias voltage at a gate terminal of the second transistor to bias the second transistor for an operation, and the second electrical current flows through the second transistor; and one or more functional circuits that are powered up by the second supply voltage.

12. The IC chip of claim 11, wherein the voltage regulator further comprises:

a variable resistor configured to change a resistance in response to a load current output from the output circuit, a frequency of a zero of the voltage regulator being a function of the resistance.

13. The IC chip of claim 12, wherein the voltage regulator further comprises:

a current detection circuit configured to detect the load current and control the variable resistor based on the detected load current to adjust the frequency of the zero.

14. The IC chip of claim 11, wherein the error detection circuit further comprises:

a differential pair coupled between the first supply voltage and a ground supply to compare the second supply voltage with the reference voltage and generate the error signal.

* * * * *